US006426610B1

(12) United States Patent
Janik

(10) Patent No.: US 6,426,610 B1
(45) Date of Patent: Jul. 30, 2002

(54) CONTROLLED FERRORESONANT CONSTANT CURRENT SOURCE

(75) Inventor: Raymond Janik, Bloomingdale, IL (US)

(73) Assignee: Shape Electronics, Inc., Addison, IL (US)

( * ) Notice: Subject to any disclaimer, the term of this patent is extended or adjusted under 35 U.S.C. 154(b) by 0 days.

(21) Appl. No.: 09/904,997

(22) Filed: Jul. 13, 2001

(51) Int. Cl.[7] ..... G05F 1/13; H01F 27/28
(52) U.S. Cl. ..... 323/248; 336/184
(58) Field of Search ..... 323/248, 355, 323/309; 363/78, 75; 336/184, 212, 215

(56) References Cited

U.S. PATENT DOCUMENTS 3,914,685 A * 10/1975 Van Gilder ..... 323/248
4,142,141 A * 2/1979 Hase ..... 323/248
4,156,175 A * 5/1979 Nissan ..... 323/248
4,439,722 A * 3/1984 Budnik ..... 323/248
4,833,338 A * 5/1989 Bartlett et al. ..... 307/17
5,886,507 A * 3/1999 Jnik ..... 323/248
5,939,838 A * 8/1999 Janik ..... 315/277

* cited by examiner

*Primary Examiner*—Rajnikant B. Patel
(74) *Attorney, Agent, or Firm*—McCormick, Paulding & Huber LLP

(57) ABSTRACT

A controlled ferroresonant constant current source includes a ferromagnetic core accommodating the below-mentioned inductors. An input coil is to be connected to an alternating voltage source. An output coil is inductively coupled to the input coil, and is to be connected to a load. A control coil is inductively coupled to the output coil, and is to be connected to a switch for regulating the current output of the constant current source. A first capacitor coil is inductively coupled to the output coil, and is to be connected to a capacitor to provide a first resonant sub-circuit having maximum gain. A second capacitor coil is inductively coupled to the control inductor, and is to be connected to the capacitor to provide a second resonant sub-circuit to control resonant gain.

15 Claims, 13 Drawing Sheets

CONTROLLED FERRORESONANT CONSTANT CURRENT SOURCE

FIELD OF THE INVENTION

This invention relates generally to a ferroresonant transformer, and more particularly to a controlled ferroresonant transformer employed as a constant current source.

BACKGROUND OF THE INVENTION

Ferroresonant transformers are employed as constant current sources. In general, the operation of ferroresonant transformers are well known. For example, see my U.S. Pat. Nos. 5,886,507 and 5,939,838, the disclosures of which are herein incorporated by reference. Linear inductors as part of the transformer include a steel core, a coil and an air gap. The inductance is determined by the core cross-sectional area, the number of turns, and the length of the air gap. As the power rating of a controlled ferroresonant current source increases, the resonant capacitance, capacitive current, and control inductive current increase, which requires the control inductor to have a lower value. To reduce the inductance of an inductor, the turns need to be reduced or the air gap increased. The cross-sectional area need to be adjusted to maintain an acceptable maximum flux density. A large air gap poses serious thermal problems because of fringing flux, which cuts through the core laminations and the magnet wire at a high loss angle, producing eddy currents that overheat the inductor and reduce efficiency. Increasing the size of the magnet wire will further reduce efficiency.

Accordingly, it is an object of the present invention to provide a ferroresonant transformer employed as a constant current source which overcomes the above-identified drawbacks associated with high power ratings.

SUMMARY OF THE INVENTION

In a first aspect of the present invention, a controlled ferroresonant constant current source includes a ferromagnetic core. An input coil is disposed about the core, and the input coil is to be connected to an alternating voltage source. An output coil is disposed about the core and is inductively coupled to the input coil. The output coil is to be connected to a load. A control coil is disposed about the core and is inductively coupled to the output coil. The control coil is to be connected to a switch for regulating the current output of the constant current source. A first capacitor coil is disposed about the core and is inductively coupled to the output coil. The first capacitor coil is to be connected to a capacitor to provide a first resonant sub-circuit having maximum gain. A second capacitor coil is disposed about the core and is inductively coupled to the control coil. The second capacitor coil is to be connected to the capacitor to provide a second resonant sub-circuit to control resonant gain.

In a second aspect of the present invention, a controlled ferroresonant constant current source includes a ferromagnetic core. An input coil is disposed about the core, and the input coil is to be connected to an alternating voltage source. An output coil is disposed about the core and is inductively coupled to the input coil. The output coil is to be connected to a load. A control coil is disposed about the core and is inductively coupled to the output coil. The control coil is connected to a switch for regulating the current output of the constant current source. A first capacitor coil is disposed about the core and is inductively coupled to the output coil. A second capacitor coil is disposed about the core and is inductively coupled to the control coil. A capacitor is connected to the first capacitor coil for providing a first resonant sub-circuit to generate maximum gain, and the capacitor is connected to the second capacitor coil for providing a second resonant sub-circuit to control resonant gain.

An advantage of the present invention is that the output and control inductors may be integrated onto the transformer core.

A second advantage is that two separate resonant sub-circuits may be implemented which both provide maximum gain and control resonant gain.

A third advantage is that low inductance, high current chokes are no longer a limiting factor to increasing the power rating of the current source.

A fourth advantage is simplified wiring between the transformer core and external components.

These and other advantages of the present invention will become more apparent in the light of the following detailed description and accompanying figures.

DETAILED DESCRIPTION OF THE PREFERRED EMBODIMENT

A controlled ferroresonant constant current source in accordance with the present invention can best be understood by first explaining its development by the inventor. In explaining the invention in the following figures, like elements are labeled with like reference numbers.

Figure 1A:
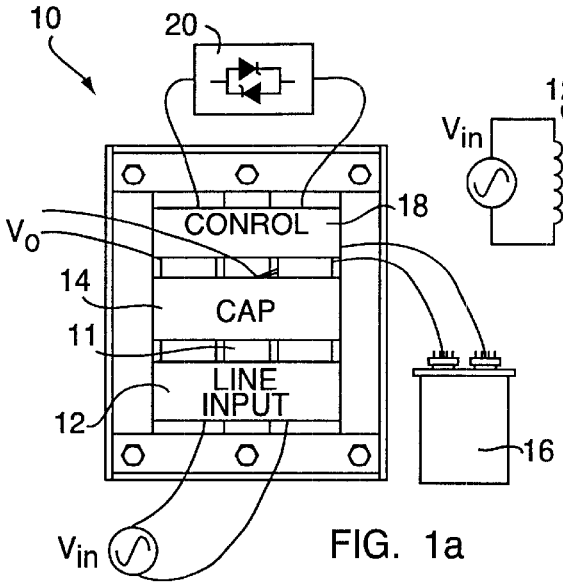
FIG. 1*a* schematically illustrates a controlled ferroresonant transformer.
Figure 1B:
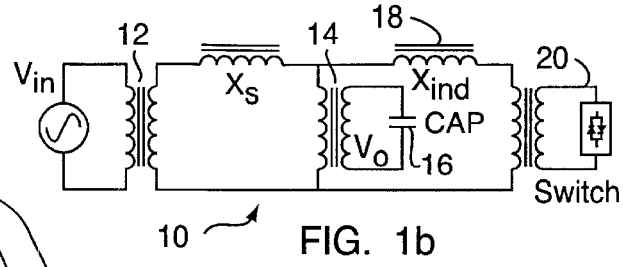
FIG. 1*b* is an equivalent electrical circuit of the controlled ferroresonant transformer of FIG. 1*a*.

With reference to FIGS. 1*a* and 1*b*, a controlled ferroresonant transformer 10 includes a ferromagnetic core 11, an input coil 12 connected to an alternating voltage source $V_{in}$, a capacitor coil 14 having an output voltage $V_O$ coupled across a resonant capacitor 16, and a control coil 18. A switch 20 places a short circuit across the control coil 18 so as to force all the flux to pass through shunt $X_{IND}$ which results in having an inductor or reactance $X_{IND}$ in parallel with the capacitor coil 14, in order for the transformer 10 to regulate the output voltage $V_O$ (see FIG. 4).

Figure 2A:
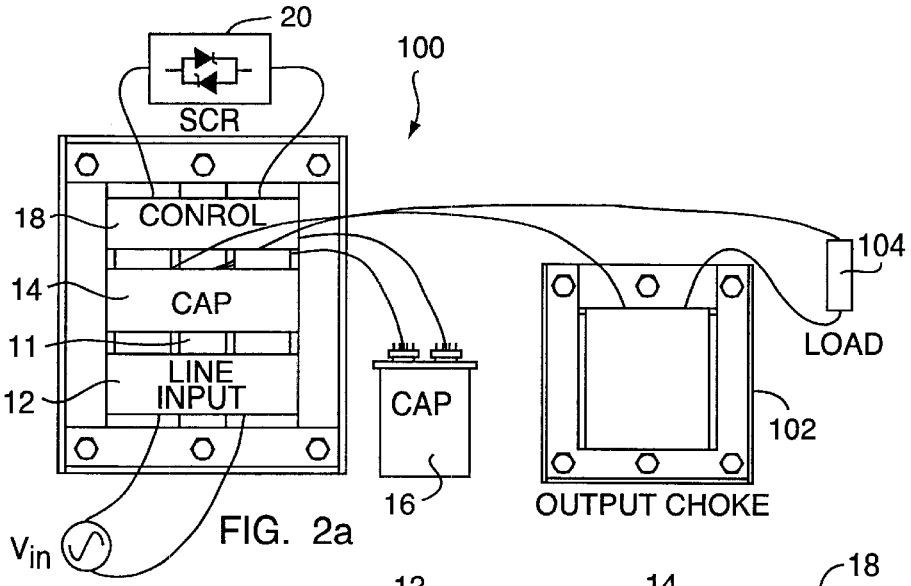
FIG. 2*a* schematically illustrates a controlled ferroresonant transformer employed as a current source.
Figure 2B:
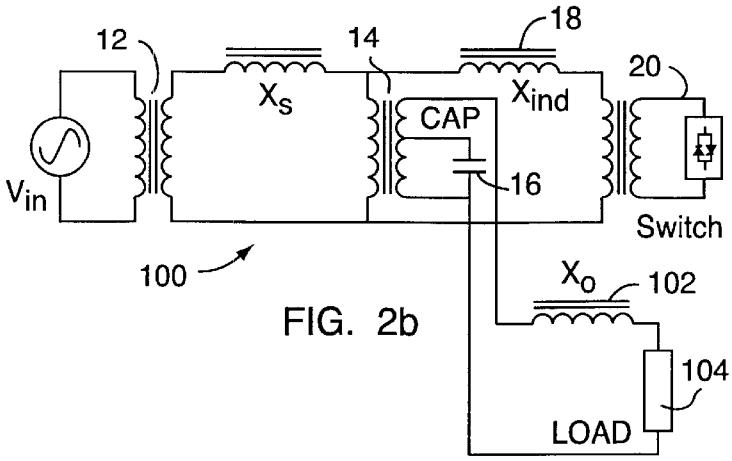
FIG. 2*b* is an equivalent electrical circuit of the current source of FIG. 2*a*.

As shown in FIGS. 2*a* and 2*b*, a ferroresonant current source 100 may be achieved by placing an output inductor 102 such as the linear inductor $X_O$ connected to a load 104, in series with the voltage output $V_O$, and by feeding back the output current instead of the output voltage.

Figure 3A:
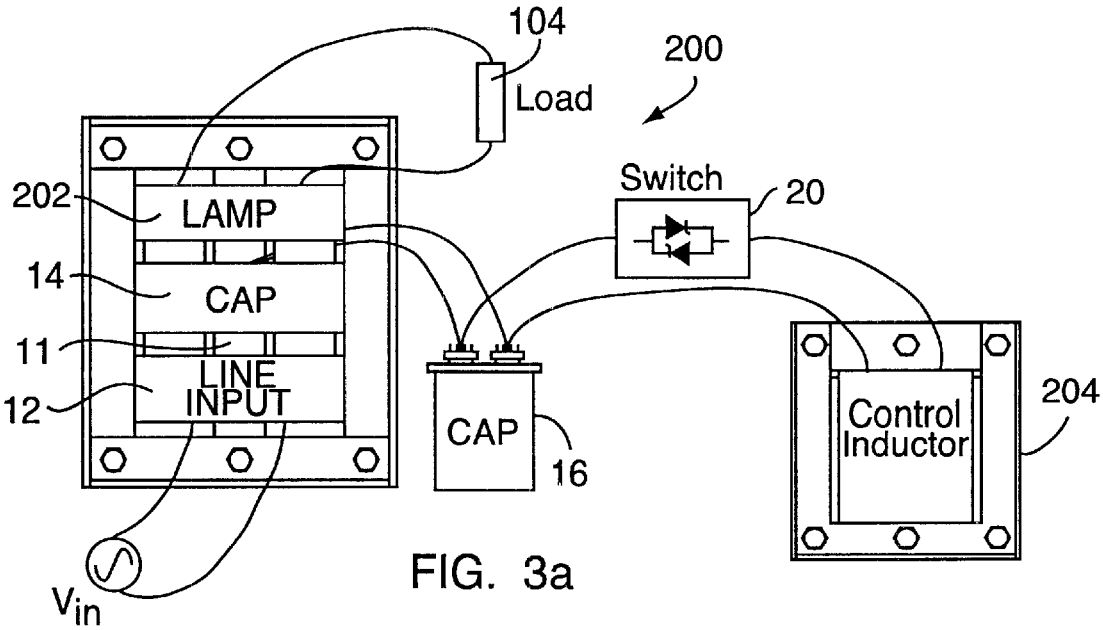
FIG. 3*a* schematically illustrates a ferroresonant transformer with the output inductor incorporated into the core of the transformer.
Figure 3B:
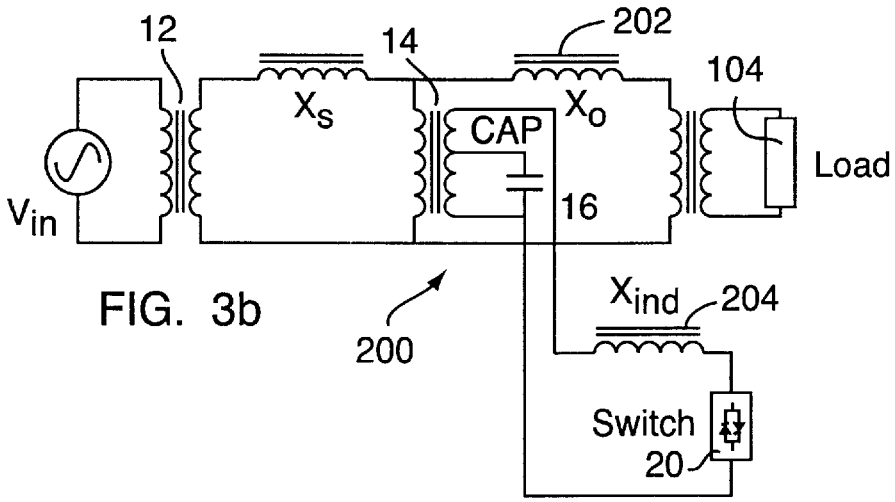
FIG. 3*b* is an equivalent electrical circuit of the ferroresonant transformer of FIG. 3*a*.

As shown in FIGS. 3*a* and 3*b*, a ferroresonant transformer 200 may be made to function as a constant current source by incorporating an output inductor, such as an output coil 202 and shunt $X_O$ into the core 11 of the ferroresonant transformer. In this instance, a control inductor 204 is employed externally of the transformer core 11.

Several factors were considered in developing an improved controlled ferroresonant constant current source. As previously mentioned, a linear inductor includes a steel core, a coil and an air gap. The inductance is determined by the core cross-sectional area, the number of turns, and the length of the air gap. As the power rating of a controlled ferroresonant current source increases, the resonant capacitance, capacitive current, and control inductive current increase, which requires the control inductor to have a lower value. To reduce the inductance of an inductor, the turns need to be reduced or the air gap increased. The cross-sectional area needs to be adjusted to maintain an acceptable maximum flux density. A large air gap poses serious thermal problems because of fringing flux, which cuts through the core laminations and the magnet wire at a high loss angle, producing eddy currents that overheat the inductor and reduce efficiency. Increasing the size of the magnet wire will further increase the magnitude of eddy currents and reduce efficiency.

Integrating the control inductor into the core of the ferroresonant transformer using magnetic shunts significantly reduces the gap loss heating effect. The air gap of the shunts is more effective in determining inductance and can be easily distributed into multiple air gaps of shorter lengths. If the control inductor is integrated with the transformer core, and the output inductor is external to the transformer core, then the inductor is subjected to the load voltage which may be extremely high in magnitude (i.e., 1000–5000V). A high voltage inductor requires a large number of turns with high electrical insulation between turns and layers. A large number of turns will also increase the resistive losses and reduce the efficiency.

Figure 4:
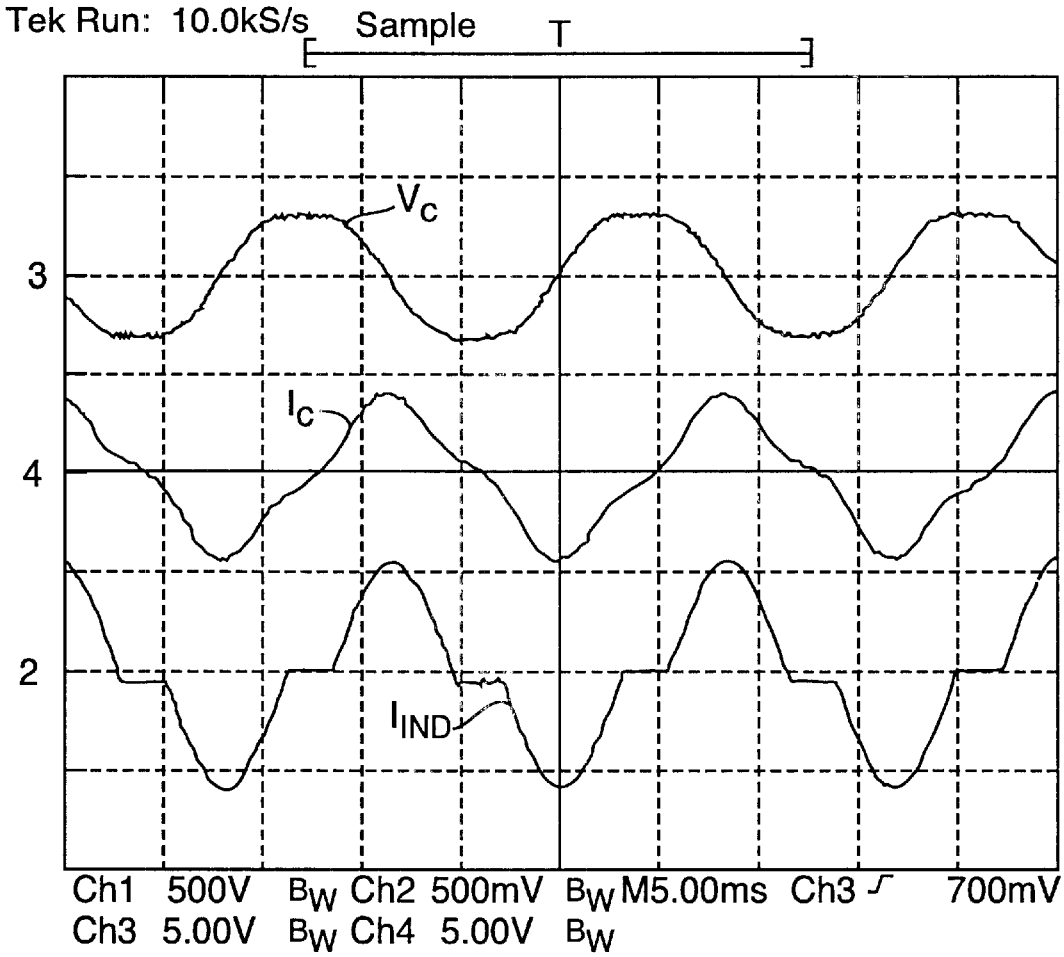
FIG. 4 is a graph illustrating various signals of the controlled ferroresonant transformer of FIGS. 1*a* and 1*b*.

The inventor has discovered that the controlled ferroresonant constant current source may be improved by integrating both the output inductor 102 and the control inductor 204 onto the core of the ferroresonant transformer while using standard EI laminations. In order for the controlled ferroresonant constant current source to operate, the control inductor must interface with the capacitor sub-circuit such that the currents are in phase. For example, as shown in FIG. 4, the capacitor inductor voltage $V_C$ and the capacitor inductor current $I_C$ are 90° out of phase with respect to each other, and the capacitor current $I_C$ and the output inductor current $I_{IND}$ are in phase with respect to each other.

Figure 5A:
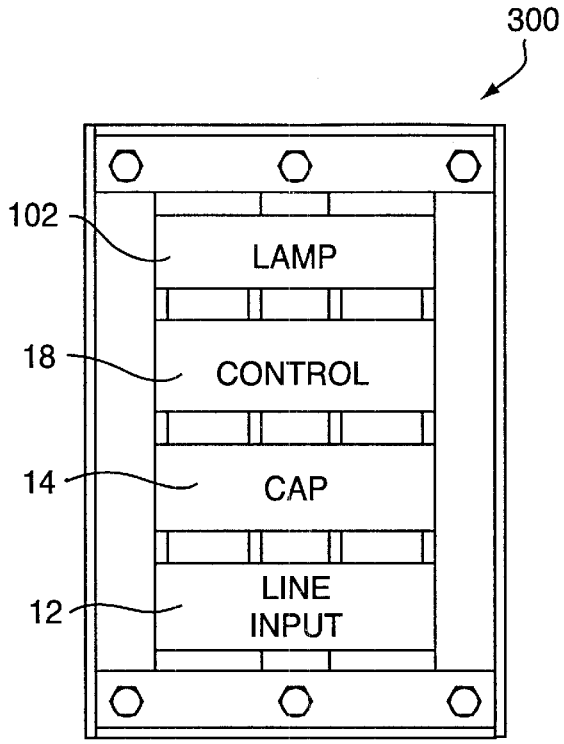
FIG. 5*a* schematically illustrates a controlled ferroresonant constant current source showing a relationship between the output and control coils and shunts.
Figure 5B:
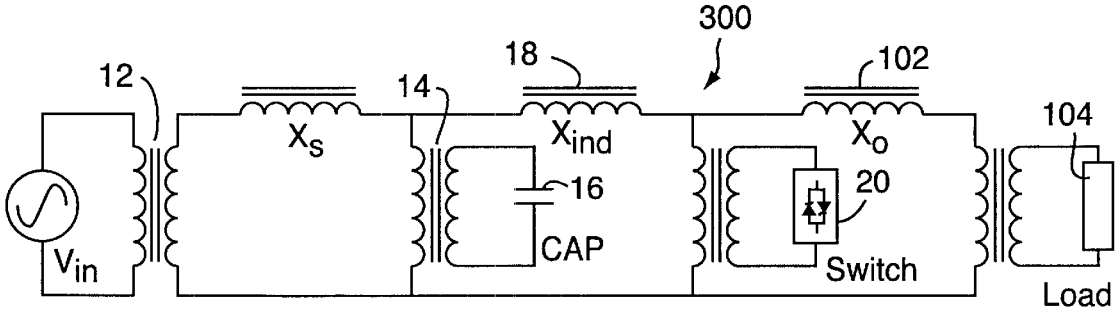
FIG. 5*b* is an equivalent electrical circuit of the constant current source of FIG. 5*a*.

A difficulty in integrating the output inductor 102 and the control inductor 204 onto the transformer core 11 is encountered when the control inductor shunts $X_{IND}$ are placed before the output inductor shunts $X_O$ as shown in the current source 300 illustrated in FIGS. 5*a* and 5*b*. In this case, each time the control switch 20 closes, the inductor diverts all of the flux away from the output circuit and hence reduces the output voltage and current to zero.

Figure 6A:
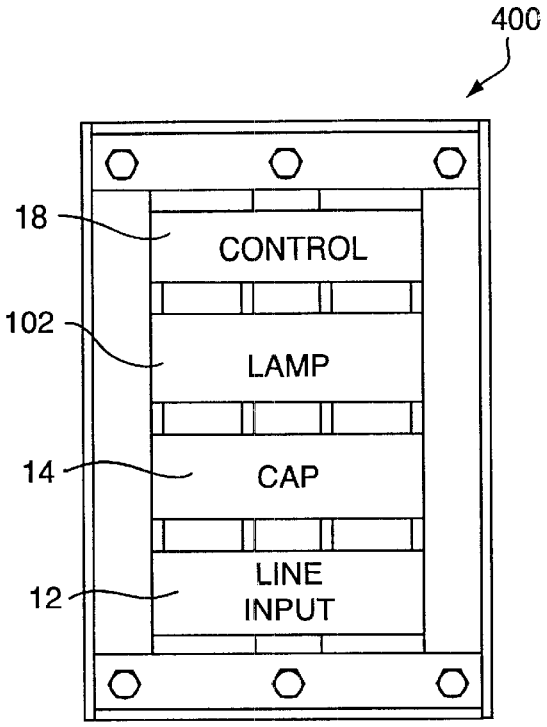
FIG. 6*a* schematically illustrates a controlled ferroresonant constant current source showing a relationship between the control and output coils and shunts.
Figure 6B:
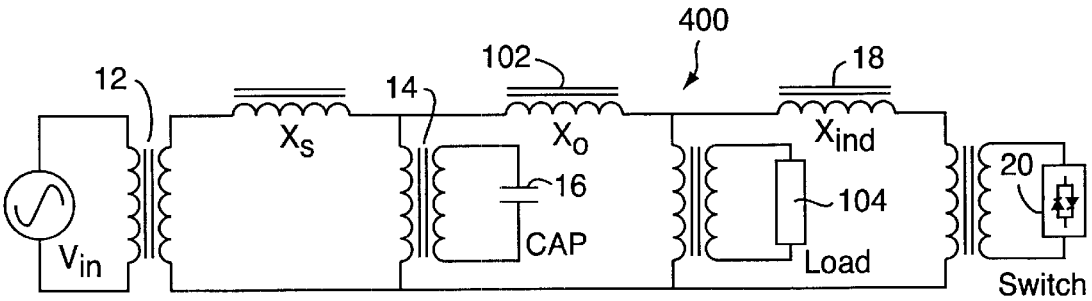
FIG. 6*b* is an equivalent electrical circuit of the constant current source of FIG. 6*a*.

Alternatively, if the control inductor shunts $X_{IND}$ are placed after the output inductor shunts $X_O$ as shown in the constant current source 400 illustrated in FIGS. 6*a* and 6*b*, then closing the switch 20 places the control reactance $X_{IND}$ in parallel with the load 104. The control inductor current is limited by the leakage reactance $X_O$. The load current is distorted by the switching effect of the control inductor switch 20.

Figure 7A:
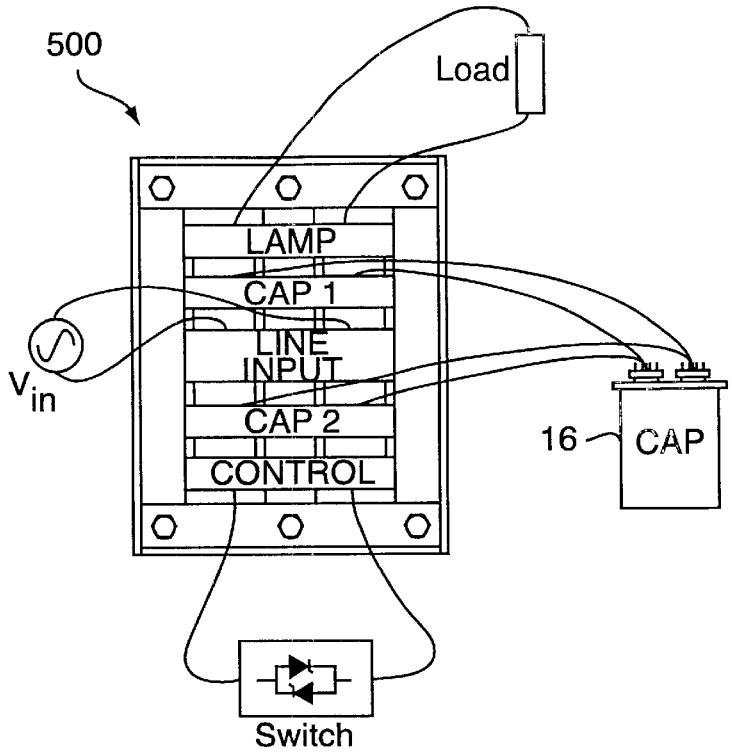
FIG. 7*a* schematically illustrates a controlled ferroresonant constant current source having two separate resonant circuits.
Figure 7B:
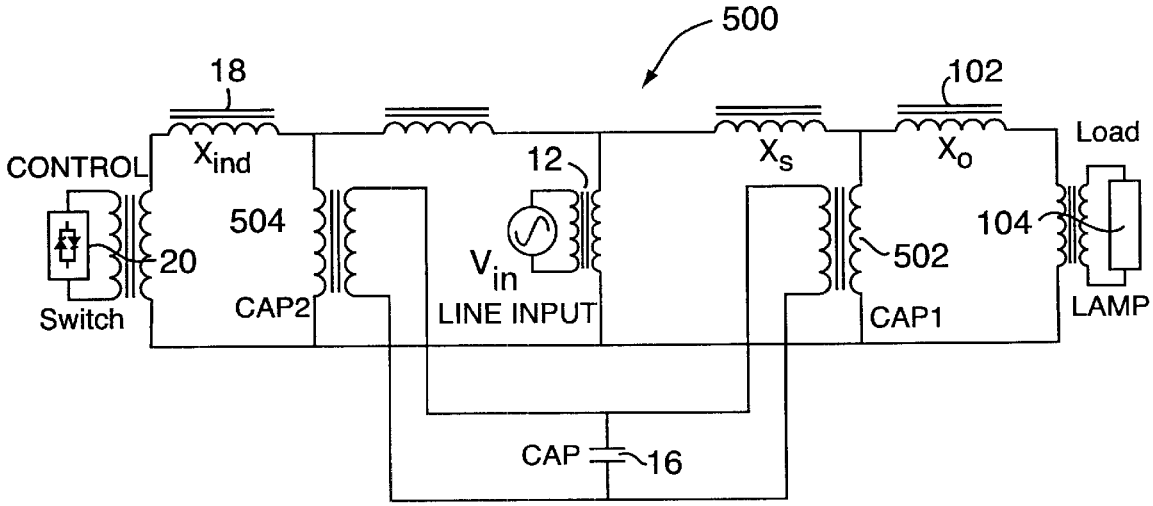
FIG. 7*b* is an equivalent electrical circuit of the constant current source of FIG. 7*a*.

Turning now to FIGS. 7*a* and 7*b*, a controlled constant current source 500 embodying the present invention will now be described. The inventor has determined that the above-mentioned drawbacks in integrating the output inductor and the control inductor are solved by creating two separate resonant sub-circuits-one to interface with the load inductor including the output coil 102 and the shunt $X_O$ to provide maximum gain, and another to interface with the control inductor, including the control coil 18 and the shunt $X_{IND}$ to control the resonant gain.

More specifically, the current source 500 has a ferromagnetic core 11 about which the transformer coils are disposed. An input coil 12 is preferably disposed about a central longitudinal portion of the core 11. A first capacitor coil 502 is adjacent to one side of and inductively coupled to the input coil 12. A second capacitor coil 504 is adjacent to an opposite side of and inductively coupled to the input coil 12. An output coil 102 is adjacent to and inductively coupled to the first capacitor coil 502. A control coil 18 is adjacent to and inductively coupled to the second capacitor coil 504. As shown in FIG. 7*a*, the coils are preferably arranged along a length of the core 11 in the following sequence: the control coil 18, the second capacitor coil 504, the input coil 12, the first capacitor coil 502 and the output coil 102.

With reference to FIG. 7*b*, the leakage reactance $X_S$ is split into two parts, each being twice the value of the leakage inductance of the circuits shown in FIGS. 5*b* and 6*b*. The effect of connecting the two capacitor sub-circuits in parallel is the same as combining the individual energy storage capability of each, with the control sub-circuit controlling both resonant sub-circuits. The total capacitor current is not split equally between the two capacitor sub-circuits, since each sub-circuit has a different load. The integration of the output inductor 102 and the control inductor 204 into the main transformer core requires more window area which can be easily obtained by replacing EI laminations with two E laminations. Strip steel or UI laminations may be employed as well.

The benefits of incorporating both the control inductor and the output inductor onto the transformer core are 1) complete isolation between all circuits; 2) simplified wiring between the transformer core and external components; 3) low inductance, high current chokes no longer a limiting factor to increasing the power rating of the current source since shunts have a wider inductance range; and 4) permits the use of standard laminations which simplifies the assembly process.

Figure 8:
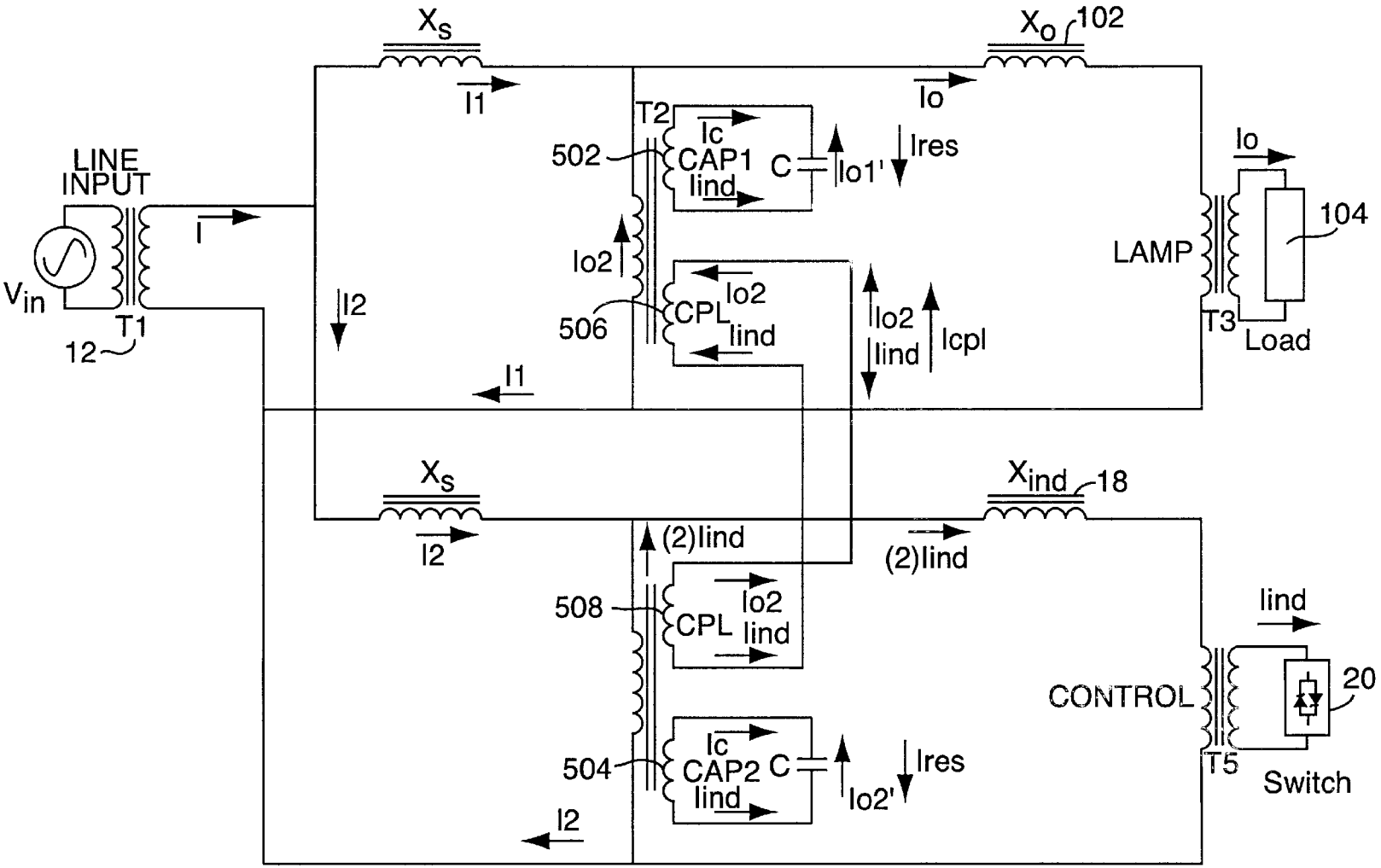
FIG. 8 is a modification of the electrical circuit of FIG. 7*b* to simplify circuit analysis.

A modification of the circuit of FIG. 7*b* is shown in FIG. 8 to simplify circuit analysis. All magnetizing and resistive losses are assumed to be negligible, and all turns ratios of ideal transformers, T1–T5 are assumed to be 1:1. The circuit of FIG. 8 differs from that of FIG. 7*b* in that first and second output capacitors 501 and 503 are equally split between the first and second capacitor coils, each carrying a current $I_C$ $$\vec{iI}_{O1}=\vec{iI}_1+j\vec{iI}_{O1}',\ \vec{iI}_{O2}=\vec{iI}_2+j\vec{iI}_{O2}',\ \vec{iI}_O=\vec{iI}_{O1}+\vec{iI}_{O2}=(+\vec{iI}_{1+i+30I_2})+j(\overrightarrow{+iI_{O1+i'+30I_{O2}}}') \quad (1)$$

The control inductor draws a current (2) X $I_{IND}$. The resonant current in the second capacitor coil is:

$$\vec{iI}_{RES}=\vec{iI}_C-\vec{iI}_{IND}-\vec{iI}_{O2}'=(\overrightarrow{+iI_{C+i+30I_{IND+i+30I_{O2}}}}') \quad (2)$$

where $I_C$ is capacitive while $I_{IND}$ and $I_{O2}'$ are inductive, and therefore $I_C$ is opposite to $I_{IND}$ and $I_{O2}'$.

The circuit of FIG. 8 is further different from that of FIG. 7*b* in the way the capacitor coils 502, 504 are linked together. As shown in FIG. 8, the circuit includes a coupling sub-circuit including two coupling windings 506, 508 connected in parallel and respectively inductively coupled to the first and second capacitor coils 502, 504. The main purpose of the coupling windings is to link together the first and second capacitor coils 502, 504. Since the two coupling windings 506, 508 are connected in parallel, the first and second capacitor coils 502, 504 have the same voltage, and therefore the first capacitor coil carries the same resonant current as that of the second capacitor coil:

$$\vec{iI}_{RES}=\vec{iI}_C-\vec{iI}_{IND}-\vec{iI}_{O1}'=(\overrightarrow{+iI_{C+i+30I_{IND+i+30I_{O1}}}}') \quad (3)$$

Figure 9A:
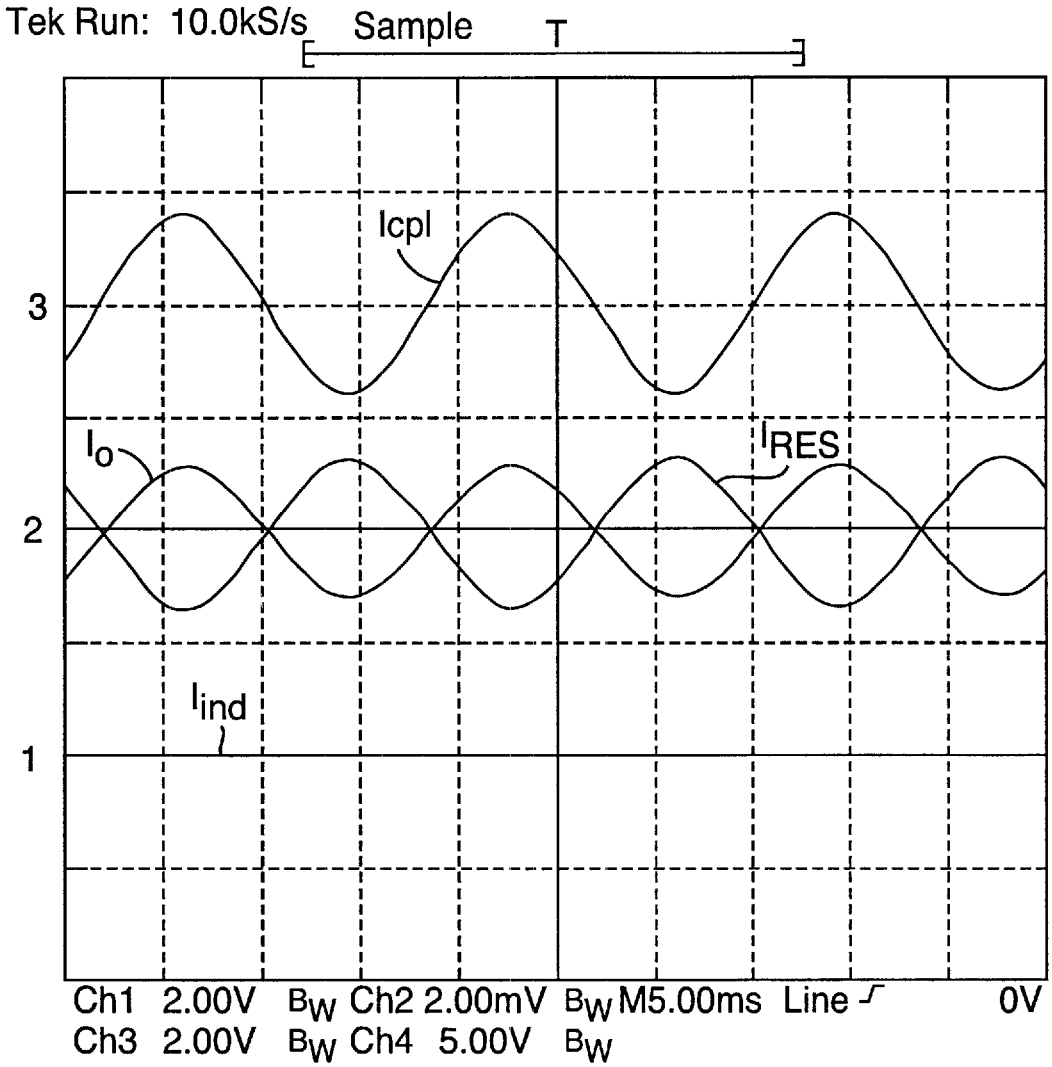
FIG. 9*a* graphically illustrates various waveforms of the constant current source of FIG. 8 during no load (short circuit), maximum output current condition.
Figure 9B:
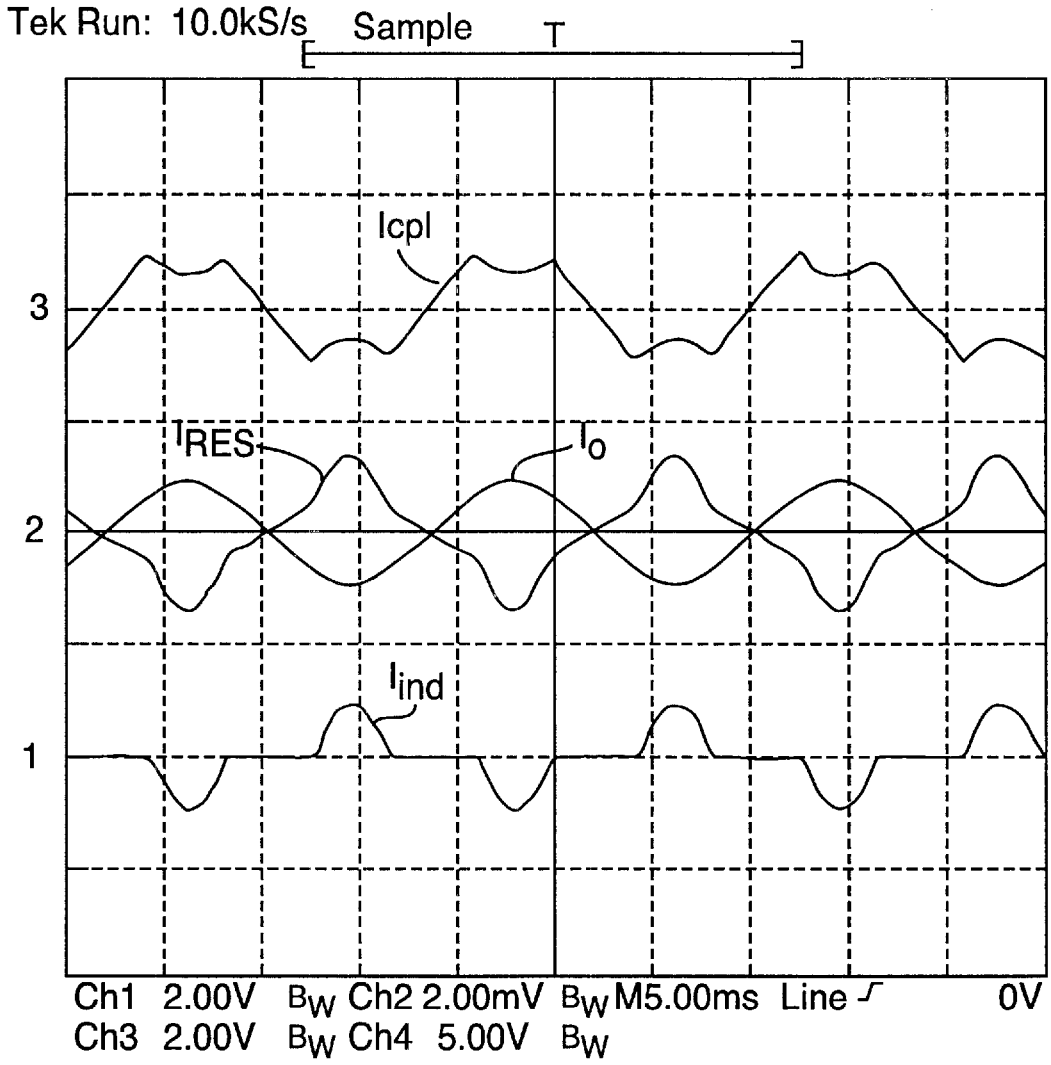
FIG. 9*b* graphically illustrates various waveforms of the constant current source of FIG. 8 during no load (short circuit), reduced output current condition.

(see, for example, FIGS. 4, 9*a* and 9*b*).

The coupling winding carries $I_{IND}$ to the first capacitor coil 502.

The load draws a current $I_O$. During short circuit (no load) condition, $I_O$ is purely inductive:

$$\vec{iI}_O=j(\overrightarrow{+iI_{O1+i'+30I_{O2}}}') \quad (4)$$

$I_{O2}$ is supplied to the load by the bottom circuit through the second coupling winding 508:

$$\vec{iI}_{CPL}=\vec{iI}_{O2}-\vec{iI}_{IND}=(+\vec{iI}_{O2+i-I_{IND}}) \quad (5)$$

In this case, $I_{O2}$ and $I_{IND}$ are both inductive and therefore in phase (see, for example, FIGS. 9*a* and 9*b*).

During short circuit condition (no load):

$$\vec{iI}=\vec{iI}_1=\vec{iI}_2=0,\ I_1=I_2=0 \quad (5)$$

and the purely inductive current $I_O$ is supplied by the resonant circuits of the first capacitor coil 502 ($I_{O1}'$) and the second capacitor coil 504 ($I_{O2}'$).

Figure 9C:
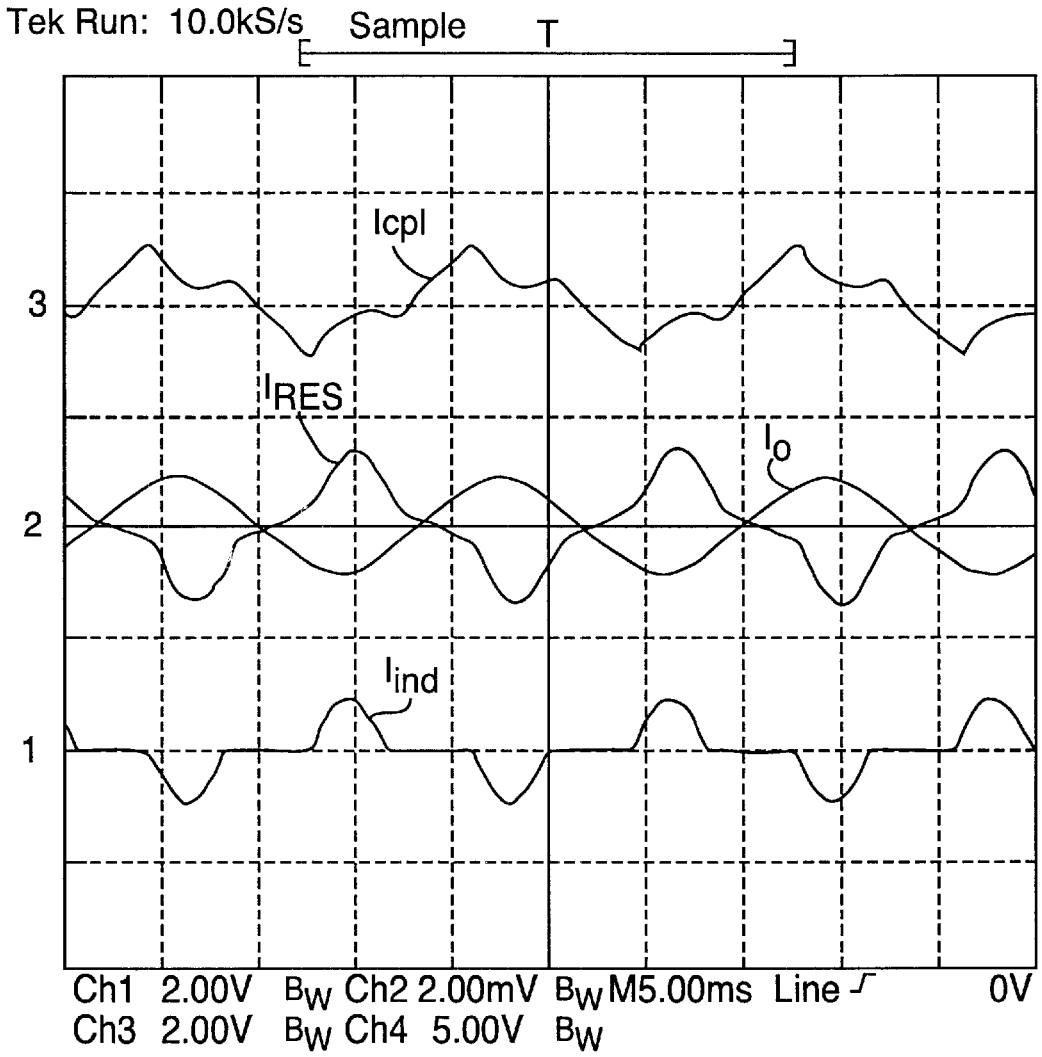
FIG. 9*c* graphically illustrates various waveforms of the constant current source of FIG. 8 during full load, maximum output current condition.
Figure 9D:
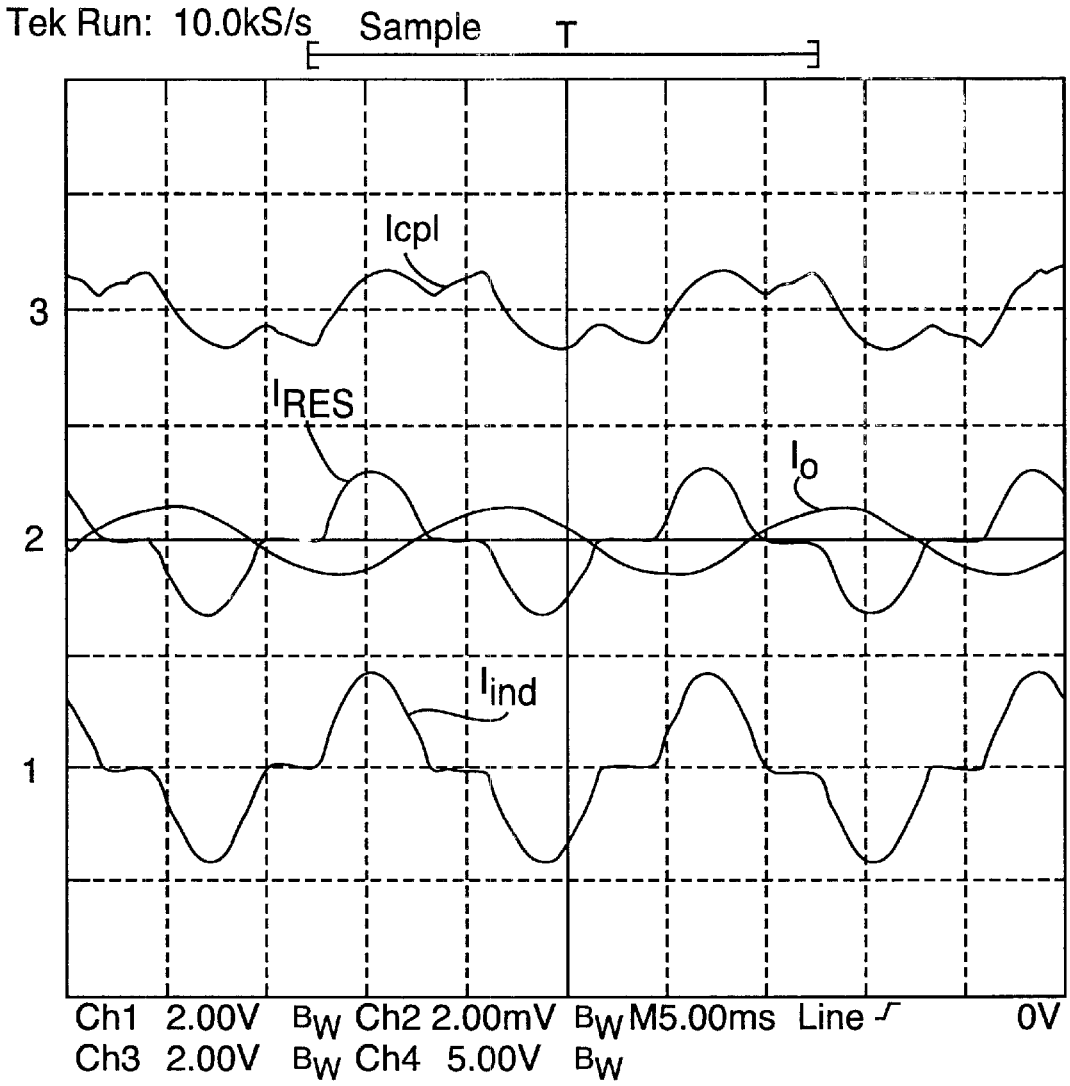
FIG. 9*d* graphically illustrates various waveforms of the constant current source of FIG. 8 during full load, reduced output current condition.

As the load increases, the real component of $I_O$, ($I_1$ and $I_2$) increases to meet the load demand. The increase in the real component of $I_O$ results in a phase shift in $I_O$ and $I_{CPL}$ relative to $I_{RES}$ and $I_{IND}$ (see, for example, FIGS. 9*c* and 9*d*).

Figure 10:
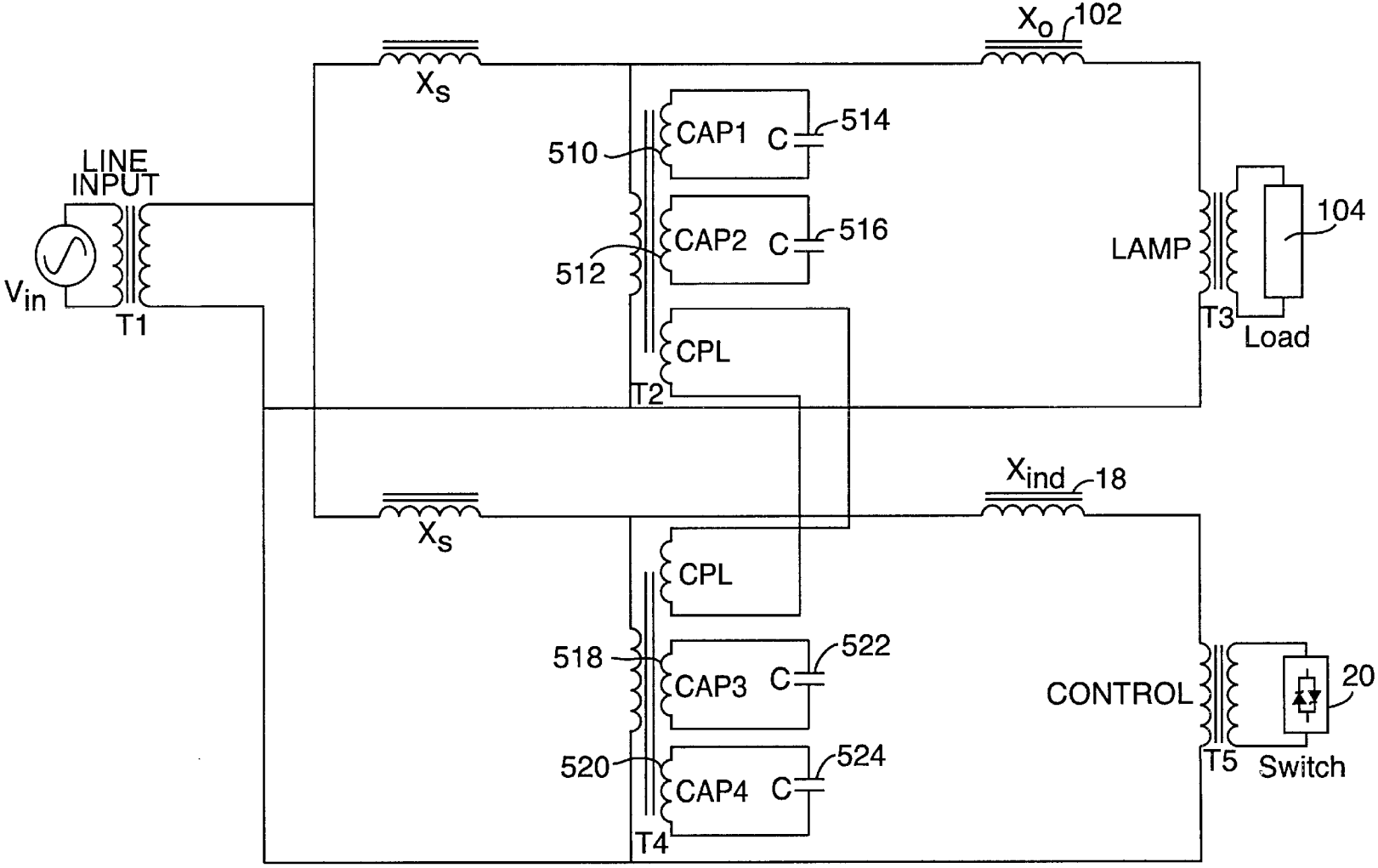
FIG. 10 schematically illustrates a variation of the electrical circuit of FIG. 8 showing the capacitor coil separated into several windings.
Figure 11:
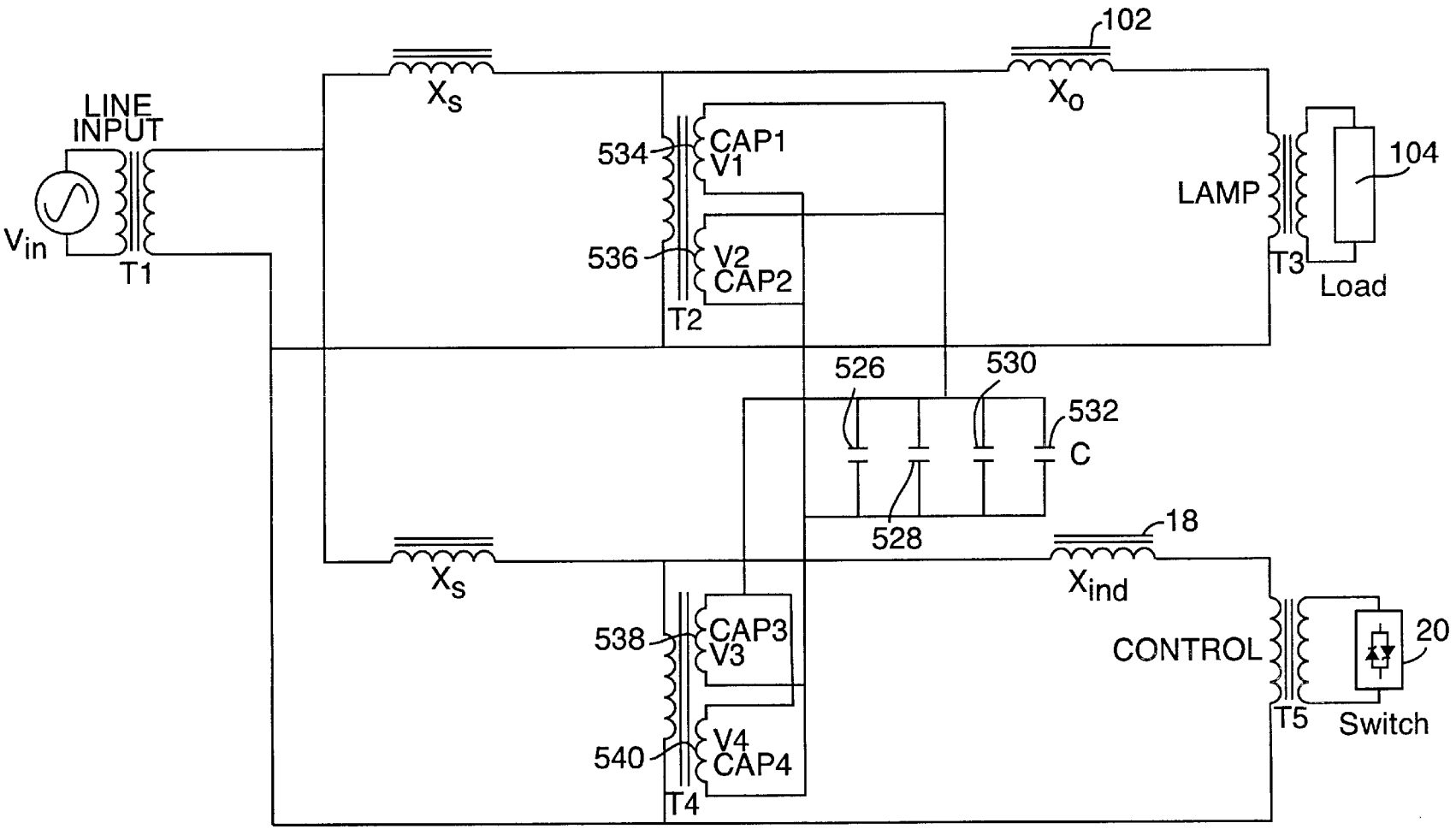
FIG. 11 schematically illustrates a variation of the electrical circuits of FIGS. 8 and 10 showing the connection of parallel capacitor windings across a capacitor bank.

The advantage of using the modified circuit of FIG. 8 over that of FIG. 7*b* and FIG. 11 is that the modified circuit allows the capacitor coil to be separated into several windings, each connected to a lower capacitance without the risk of circulating currents, as is the case in FIG. 11 described hereinbelow. As shown in FIG. 10, for example, the first capacitor coil 502 of FIG. 8 is separated into capacitor windings 510 and 512 that are respectively associated with capacitors 514 and 516. Likewise, the second capacitor coil 504 of FIG. 8 is divided into capacitor windings 518 and 520 that are respectively associated with capacitors 522 and 524. This is especially useful with a high power constant current source where the total resonant capacitive current is too large for being accommodated by a single magnet wire.

Alternatively as shown in FIG. 11, the circuit of FIG. 7*b* may be modified such that the capacitor 16 may be substituted with a plurality of capacitors such as the four capacitors 526, 528, 530 and 532. Further, the first capacitor coil 502 of FIG. 7*b* may be substituted with a plurality of parallel capacitor windings, such as the two capacitor windings 534 and 536. Similarly, the second capacitor coil 504 of FIG. 7*b* may be substituted with a plurality of parallel capacitor windings, such as the two capacitor windings 538 and 540 to increase current carrying capacity of the capacitor coil. A drawback with connecting parallel capacitor windings to increase current carrying capacity of the capacitor coil results in circulating current between the windings which may be several times larger than the current which may be otherwise carried by a single winding. This is due to a difference of induced voltage (V1–V2, V3–V4) between the windings. One way to overcome this is to transpose the wires during coil winding. While transposing wires in bifilar winding is straightforward, the task becomes increasingly complicated with high current coils employing more than two windings in parallel. However, transposing the wires and employing more than two wires in parallel is not a practical remedy. These weaknesses are overcome by the circuit previously shown and described with respect to FIG. 10.

Although the invention has been shown and described in preferred embodiments, it should be understood that numerous modifications can be made without departing from the spirit and scope of the present invention. Accordingly, the present invention has been shown and described by way of illustration rather than limitation.

What is claimed is:

1. A controlled ferroresonant constant current source, comprising:

a ferromagnetic core;

an input coil disposed about the core, the input coil to be connected to an alternating voltage source;

an output coil disposed about the core and inductively coupled to the input coil, the output coil to be connected to a load;

a control coil disposed about the core and inductively coupled to the output coil, the control coil to be connected to a switch for regulating the current output of the constant current source;

a first capacitor coil disposed about the core and inductively coupled to the output coil, the first capacitor coil to be connected to a capacitor to provide a first resonant sub-circuit having maximum gain; and a second capacitor coil disposed about the core and inductively coupled to the control coil, the second capacitor coil to be connected to a capacitor to provide a second resonant sub-circuit to control resonant gain.

2. A controlled ferroresonant constant current source as defined in claim 1, wherein the coils are arranged along a length of the core in the following sequence: control coil, second capacitor coil, input coil, first capacitor coil and output coil.

3. A controlled ferroresonant constant current source as defined in claim 1, wherein each of the first and second capacitor coils includes a plurality of windings disposed about the core.

4. A controlled ferroresonant constant current source as defined in claim 1, wherein the ferromagnetic core includes EI laminations.

5. A controlled ferroresonant constant current source as defined in claim 1, wherein the ferromagnetic core includes two E laminations.

6. A controlled ferroresonant constant current source as defined in claim 1, wherein the ferromagnetic core includes strip steel.

7. A controlled ferroresonant constant current source as defined in claim 1, wherein the ferromagnetic core includes UI laminations.

8. A controlled ferroresonant constant current source, comprising:

a ferromagnetic core;

an input coil disposed about the core, the input coil to be connected to an alternating voltage source;

an output coil disposed about the core and inductively coupled to the input coil, the output coil to be connected to a load;

a control coil disposed about the core and inductively coupled to the output coil, the control coil connected to a switch for regulating the current output of the constant current source;

a first capacitor coil connected to a capacitor, and disposed about the core and inductively coupled to the output coil; and a second capacitor coil connected to a capacitor, and disposed about the core and inductively coupled to the control coil, the first capacitor coil for providing a first resonant sub-circuit to generate maximum gain, and the second capacitor coil for providing a second resonant sub-circuit to control resonant gain.

9. A controlled ferroresonant constant current source as defined in claim 8, wherein the coils are arranged along a length of the core in the following sequence: control coil, second capacitor coil, input coil, first capacitor coil and output coil.

10. A controlled ferroresonant constant current source as defined in claim 8, wherein each of the first and second capacitor coils includes a plurality of windings disposed about the core and to be connected to an associated capacitor.

11. A controlled ferroresonant constant current source as defined in claim 8, wherein the capacitor associated with the first capacitor coil includes a plurality of capacitors coupled in parallel with one another, and the capacitor associated with the second capacitor coil includes a plurality of capacitors coupled in parallel with one another.

12. A controlled ferroresonant constant current source as defined in claim 8, wherein the ferromagnetic core includes EI laminations.

13. A controlled ferroresonant constant current source as defined in claim 8, wherein the ferromagnetic core includes two E laminations.

14. A controlled ferroresonant constant current source as defined in claim 8, wherein the ferromagnetic core includes strip steel.

15. A controlled ferroresonant constant current source as defined in claim 8, wherein the ferromagnetic core includes UI laminations.

* * * * *

UNITED STATES PATENT AND TRADEMARK OFFICE

CERTIFICATE OF CORRECTION

PATENT NO. : 6,426,610 B1
DATED : July 30, 2002
INVENTOR(S) : Raymond Janik

It is certified that error appears in the above-identified patent and that said Letters Patent is hereby corrected as shown below:

Column 5,

Line 17, should read $\vec{I}_{O1} = \vec{I}_1 + j\vec{I}_{O1}'$, $\vec{I}_{O2} = \vec{I}_2 + j\vec{I}_{O2}'$, $\vec{I}_O = \vec{I}_{O1} + \vec{I}_{O2} = \left(\vec{I}_1 + \vec{I}_2\right) + j\left(\vec{I}_{O1}' + \vec{I}_{O2}'\right)$ Line 24, should read $\vec{I}_{RES} = \vec{I}_C - \vec{I}_{IND} - \vec{I}_{O2}' = \overrightarrow{\left(I_C + I_{IND} + I_{O2}'\right)}$ Line 41, should read $\vec{I}_{RES} = \vec{I}_C - \vec{I}_{IND} - \vec{I}_{O1}' = \overrightarrow{\left(I_C + I_{IND} + I_{O1}'\right)}$ Line 49, should read $\vec{I}_O = j\left(\vec{I}_{O1}' + \vec{I}_{O2}'\right)$ Line 54, should read $\vec{I}_{CPL} = \vec{I}_{O2} - \vec{I}_{IND} = \left(\vec{I}_{O2} - \vec{I}_{IND}\right)$ Line 59, should read $\vec{I} = \vec{I}_1 + \vec{I}_2 = 0$, $I_1 = I_2 = 0$ Signed and Sealed this Thirtieth Day of September, 2003

JAMES E. ROGAN
*Director of the United States Patent and Trademark Office*